US008231161B2

(12) United States Patent
Longley et al.

(10) Patent No.: US 8,231,161 B2
(45) Date of Patent: Jul. 31, 2012

(54) DRINKING VESSEL CARRIER

(76) Inventors: Paul Graham Longley, Abbeymead (GB); Nigel John Longley, Abbeymead (GB)

( * ) Notice: Subject to any disclaimer, the term of this patent is extended or adjusted under 35 U.S.C. 154(b) by 186 days.

(21) Appl. No.: 12/594,587

(22) PCT Filed: Jan. 11, 2008

(86) PCT No.: PCT/GB2008/000091

§ 371 (c)(1),
(2), (4) Date: Oct. 2, 2009

(87) PCT Pub. No.: WO2008/122748

PCT Pub. Date: Oct. 16, 2008

(65) Prior Publication Data

US 2010/0116704 A1 May 13, 2010

(30) Foreign Application Priority Data

Apr. 4, 2007 (GB) ..... 0706535.2

(51) Int. Cl.
*A47G 23/06* (2006.01)
*A47G 23/02* (2006.01)
*B65D 1/00* (2006.01)

(52) U.S. Cl. ..... 294/167; 294/159

(58) Field of Classification Search ..... 294/167, 294/27.1, 31.2, 143, 148, 159; 206/216, 206/549; 220/737; 229/117.23
See application file for complete search history.

(56) References Cited

U.S. PATENT DOCUMENTS

| | | | | | |
|---|---|---|---|---|---|
| 2,153,391 | A | * | 4/1939 | Projansky | 294/159 |
| 2,625,308 | A | * | 1/1953 | Green | 294/143 |
| 3,951,259 | A | * | 4/1976 | Oglesbee | 294/159 |
| 4,624,496 | A | * | 11/1986 | Bengtson | 294/148 |

FOREIGN PATENT DOCUMENTS

| | | | |
|---|---|---|---|
| DE | 29908061 | | 9/2000 |
| DE | 202004011876 | | 10/2004 |
| EP | 0099509 | | 2/1984 |
| GB | 2210776 | * | 6/1989 |
| GB | 2339142 | | 1/2000 |

OTHER PUBLICATIONS

UK Search report of counterpart patent application.

* cited by examiner

*Primary Examiner* — Paul T Chin

(57) ABSTRACT

A drinking vessel carrier (10) comprises four support members (12, 14, 16, 18) pivotally mounted to one-another and a handle (20). An aperture (24) is provided in each support member (12, 14, 16, 18) for receiving a vessel to be supported. The support members (12, 14, 16, 18) are arranged in a stack and can be fanned or splayed out to different angular positions. When splayed out in one direction the support members lock 90° apart and when splayed out in the other direction, three of the support members (14, 16, 18) lock 120° apart, with the other support member (12) lying under the adjacent support member (14).

14 Claims, 5 Drawing Sheets

20
74
18
78
70
72
76
94
92
86
84
90
80
82

DRINKING VESSEL CARRIER

The present invention relates to a drinking vessel carrier.

Various drinking vessel carriers have been proposed, for example as disclosed in GB 2339142 A, in which a plurality of substantially planar support members are arranged to overlie one-another in a stack. The support members each have an aperture therethrough for receiving and supporting a vessel, for example, a glass or cup. The support members are mounted about a common pivot and can be splayed outwardly in the manner of a fan about the pivot.

A more advanced carrier of similar construction is disclosed in DE 20 2004 011 876 U1. In this disclosure, four support members also overlie one another in a stack and are fanned out or splayed to receive drinking vessels. The support members are connected to a central handle which folds between an operable position and a closed position. However, the folding mechanism is complicated and comprises a sliding spindle arrangement, It is an object of the invention to provide an improved drinking vessel carrier.

According to a first aspect of the present invention there is provided a drinking vessel carrier comprising a plurality of support members, each support member having a space therein for receiving a vessel to be supported, the support members being mounted in a stack about a pivotal axis and being adapted to be fanned out by rotation about the pivotal axis to different angular positions, characterised in that the support members are adapted to be retained in a first set of angular positions when rotated in one angular direction about the pivot and in a second set of angular positions when rotated in the other angular direction about the pivot.

Preferably there are four support members mounted about the pivotal axis.

Preferably the four support members are retained substantially 90 degrees apart when rotated in the first angular direction.

It is an advantage of the invention that two vessels can be carried in a balanced manner by using two opposing support members. Also, four vessels can be carried in a balanced manner by using all four support members.

Preferably three of the four support members are retained substantially 120 degrees apart when rotated in the other angular direction, the fourth support member under-lying one of the other support members.

It is an advantage of the invention that three vessels can be carried in a balanced manner in three substantially equi-spaced support members.

Preferably co-operating formations are disposed on adjacent support members for retaining the support members in said first and second sets of angular positions.

Preferably the co-operating formations retain the support members in a closed position in which the support members overlie one another.

Preferably each co-operating formation includes a detent formed on one of said support members which slides within an arcuate slot formed in the adjacent support member.

Preferably recesses are provided in the base of each arcuate slot corresponding to positions in which the adjacent support members are retained relative to one another.

Preferably a handle is pivotally mounted to an uppermost support member about a pivotal axis and is movable between a closed position in which the handle lies flat against and is substantially parallel with the uppermost support member and an open position in which the handle extends substantially perpendicularly away from the uppermost support member.

Preferably the handle includes a pair of resilient legs having spigots thereon for engagement with apertures provided in respective formations on a surface of the uppermost support member.

Preferably detent means is provided on at least one of the resilient legs and locates in one of two recesses provided on the formation for locking the handle in the open and closed positions respectively.

Preferably a resilient hollow spigot having catch means at a distil end thereof is provided on an outermost support member of the stack.

Preferably a further hollow spigot is provided on the other outermost support member of the stack, the resilient hollow spigot being adapted to be received in the hollow spigot and the catch means to engage in a circumferential recess formed in the surface of the said other outermost support member.

Preferably a plug is adapted to be inserted in the end of the resilient hollow spigot, thereby locking the catch means into engagement with the circumferential recess formed in the said other outermost support member.

Preferably the outer surface of the hollow spigot provides a bearing surface for the or each other support member.

Preferably the space for receiving a vessel to be supported is an aperture, an internal edge of which is formed with ridges for engagement with the vessel to be supported.

Preferably the drinking vessel carrier is made from plastics.

For a better understanding of the present invention, and to show more clearly how it may be carried into effect, reference will now be made, by way of example, to the accompanying drawings, in which.

Figure 1:
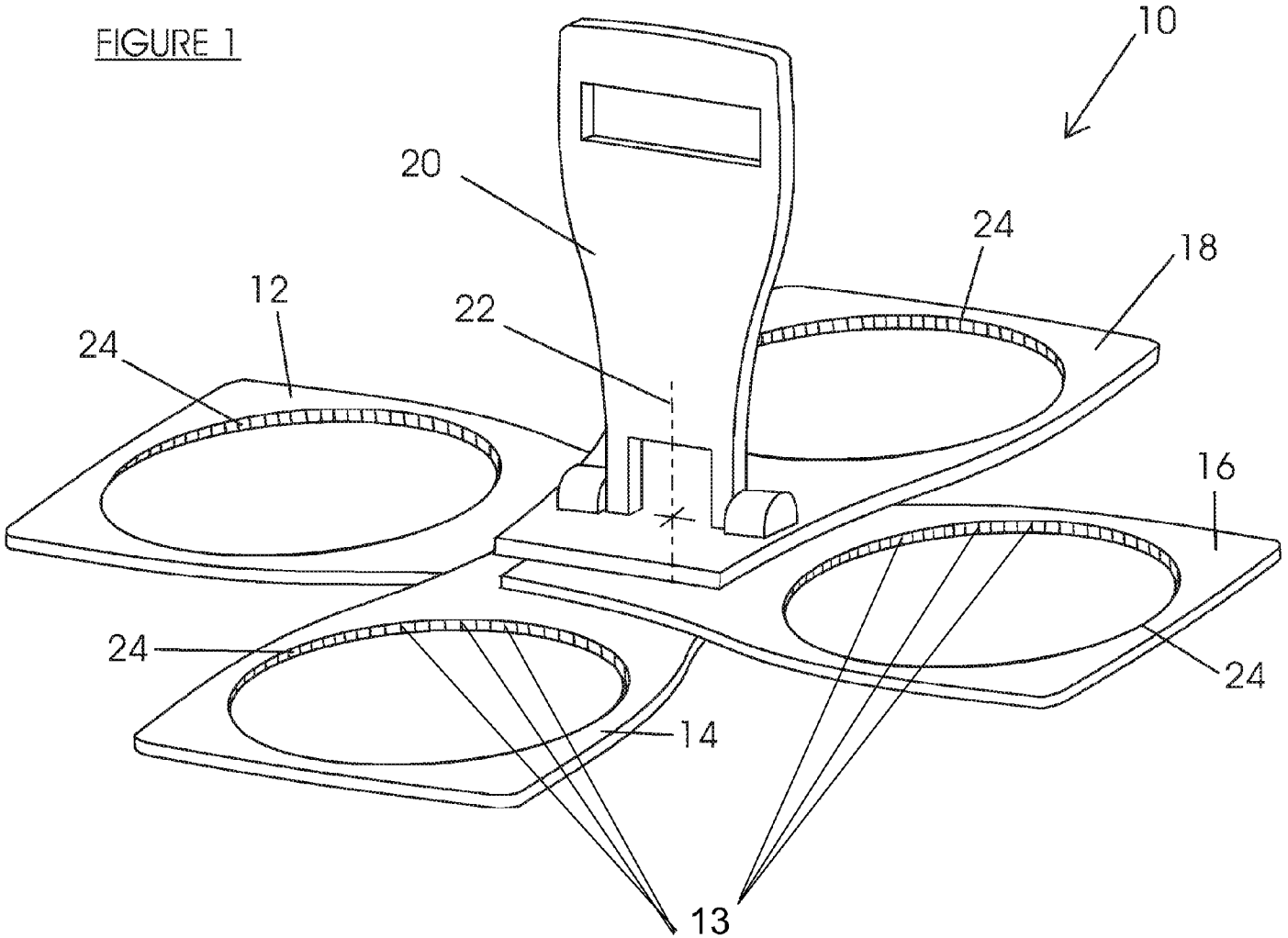
FIG. 1 shows a schematic perspective view of a drinking vessel carrier in an open position for carrying four vessels.
Figure 2:
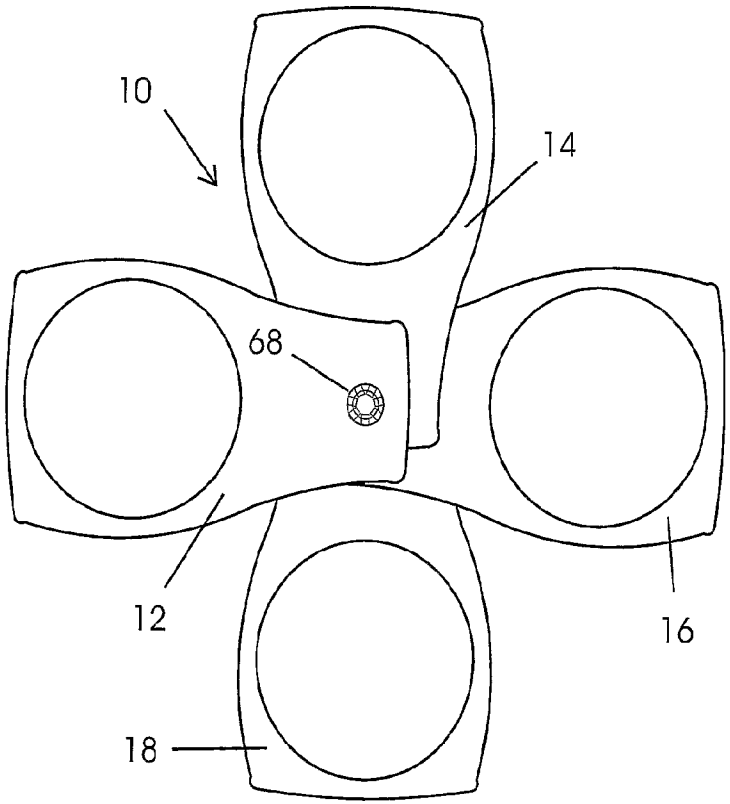
FIG. 2 shows a schematic plan view from below of the drinking vessel carrier of FIG. 1 in an operative position for carrying four vessels.

Referring firstly to FIG. 1, a drinking vessel carrier is indicated generally at 10. The drinking vessel carrier 10 is shown in an open position for receiving four vessels to be carried and includes first, second, third and fourth lamellas or support members 12, 14, 16, 18 and a handle 20. The underside of the drinking vessel carrier 10 is shown in FIG. 2. Each support member 12, 14, 16, 18 is a planar member, has a thickness of approximately 2 mm and has a circular aperture 24 there through for supporting a vessel, for example a glass or cup. The circular aperture 24 is typically 76 mm in diameter, but may be of any desired size. The internal edge of each aperture 24 is provided with ridges 13 or is textured in order to more securely grip a vessel placed in the aperture. The edges of each aperture 24 may be perpendicular to the plane of each support member or inclined at an angle, as desired. The support members 12, 14, 16, 18 have an identical peripheral shape, which is narrower at one end than the other, the wider end having the circular aperture 24 there through.

Figure 3:
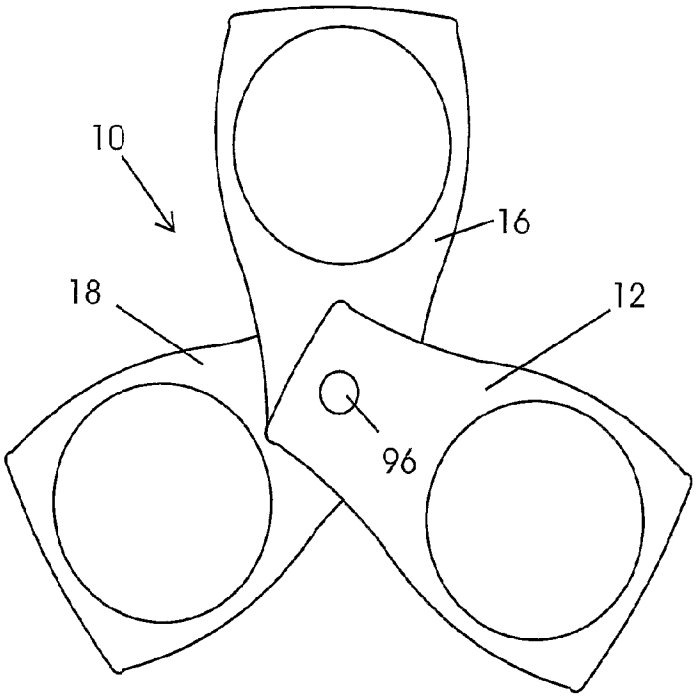
FIG. 3 shows a schematic plan view from below of the drinking vessel carrier of FIG. 1 in an operative position for carrying three vessels.
Figures 4A, 4B, 4C, 4D, 5:
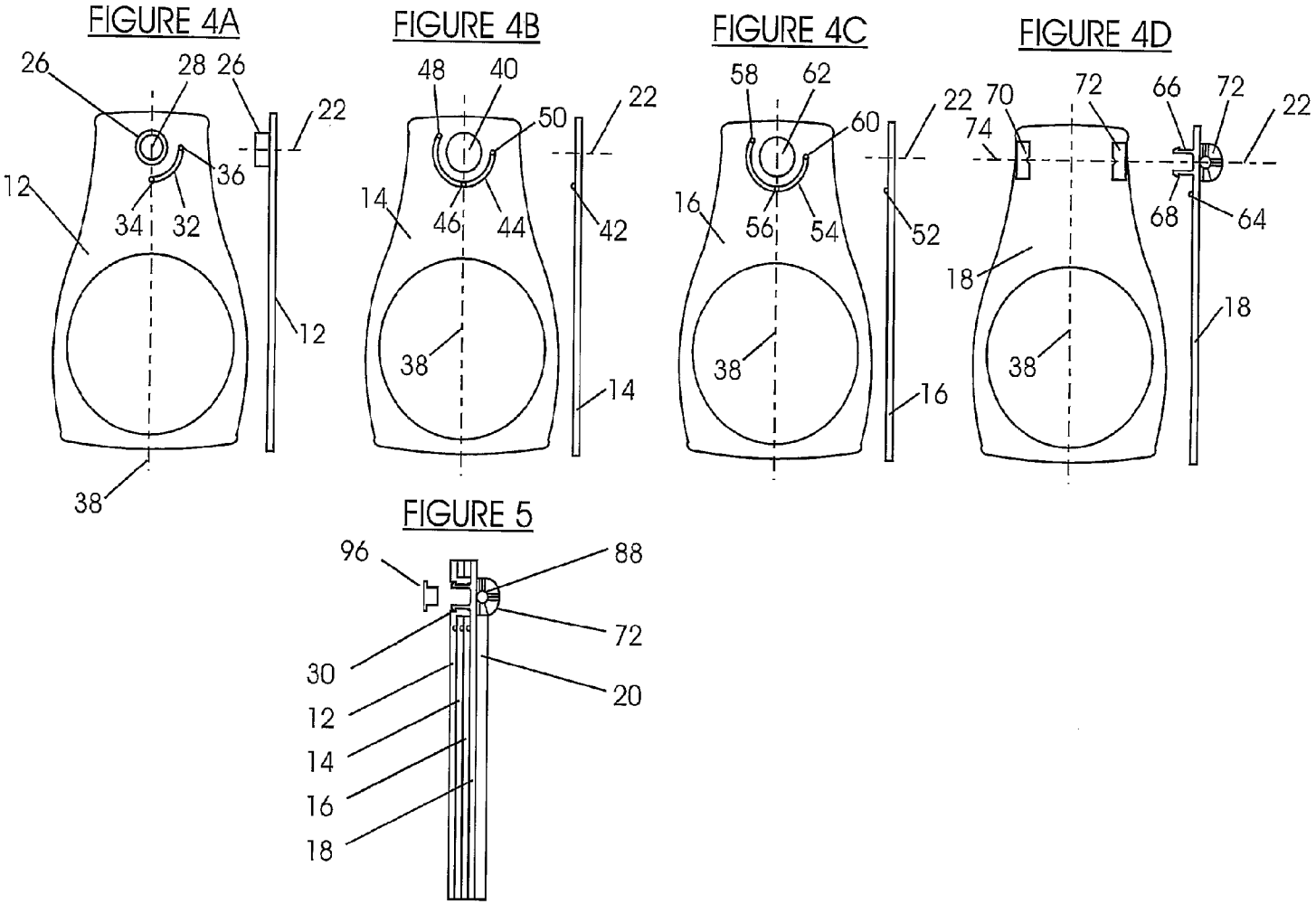
FIG. 4A shows a schematic plan view of one side of a first support member of the drinking vessel carrier together with a cross-sectional view through the first support member.
FIG. 4B shows a schematic plan view of one side of a second support member of the drinking vessel carrier together with a cross-sectional view through the first support member.
FIG. 4C shows a schematic plan view of one side of a third support member of the drinking vessel carrier together with a cross-sectional view through the first support member.
FIG. 4D shows a schematic plan view of one side of a fourth support member of the drinking vessel carrier together with a cross-sectional view through the first support member.
FIG. 5 shows a schematic cross sectional view of the vessel carrier of FIG. 1 in a closed position.
Figures 6A, 6B, 6C:
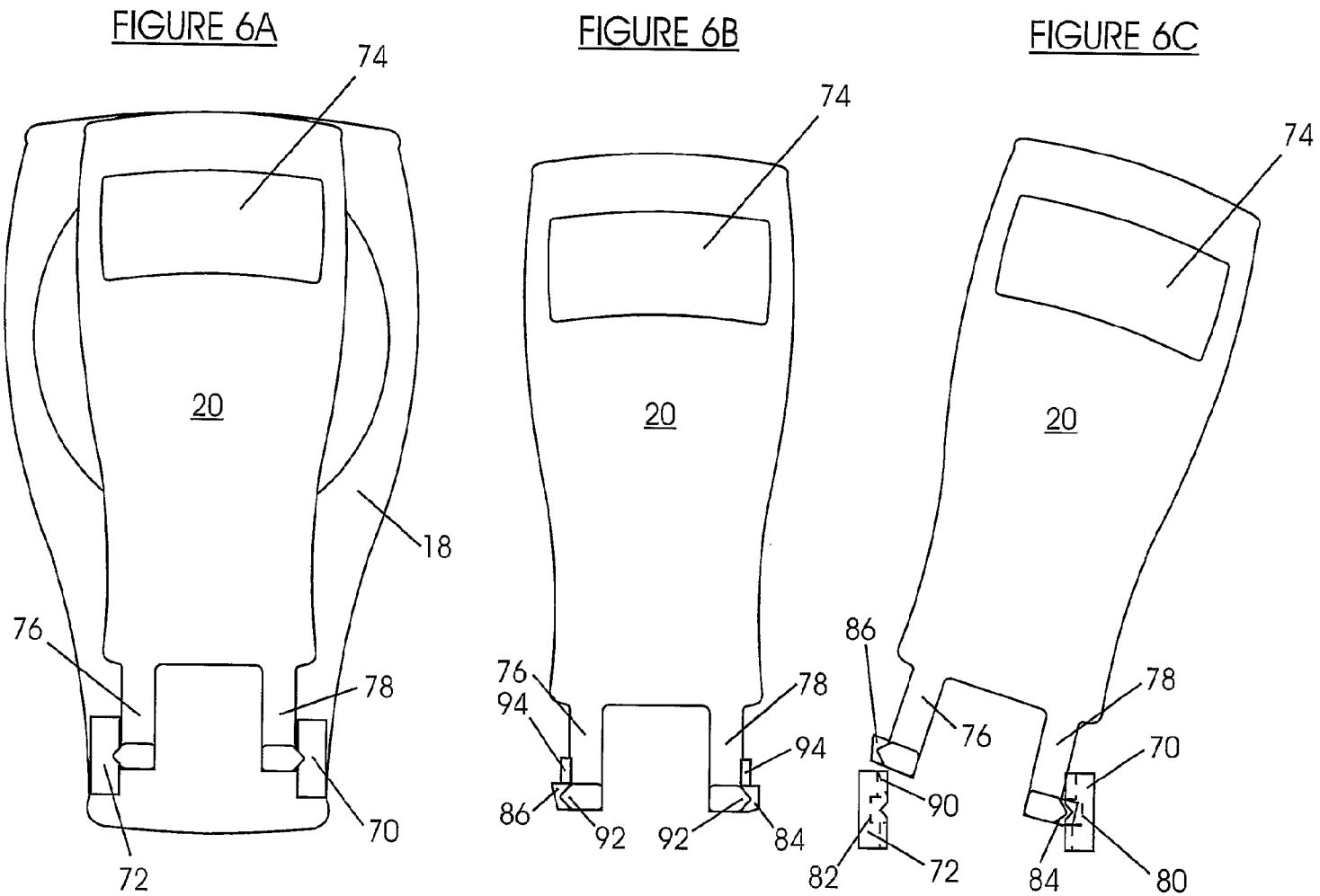
FIG. 6A shows a schematic plan view from above of the vessel carrier of FIG. 1 in a closed position.
FIG. 6B shows a schematic plan view of one side of a handle of the vessel carrier of FIG. 1.
FIG. 6C shows a schematic plan view of one side of the handle of FIG. 6B being inserted in recesses provided in formations formed on the fourth support member shown in FIG. 4D.
Figure 7:
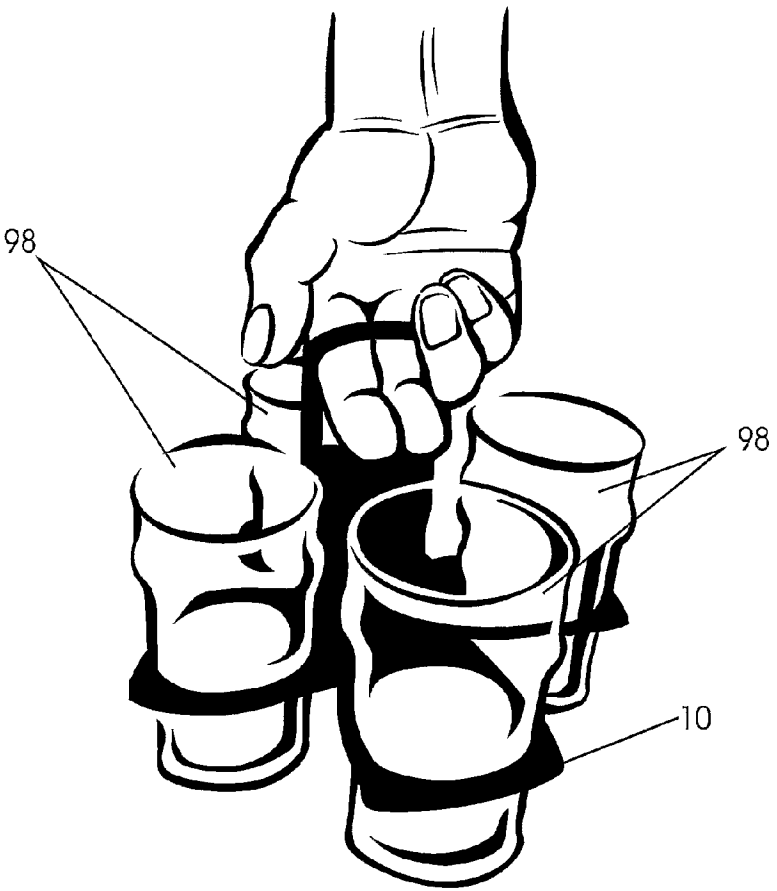
FIG. 7 shows a perspective view of the vessel carrier of FIG. 1 in use.

The support members 12, 14, 16, 18 are arranged to pivot about an axis 22 from a closed position as shown in FIGS. 5 and 6A, in which the support members are aligned in a stack to an open or splayed position, as shown in FIGS. 1, 2, 3 and 7. When the support members 12, 14, 16, 18 are opened in one direction around the pivot 22, they are all equi-angularly splayed to positions substantially 90° apart for supporting four vessels, as shown in FIGS. 1, 2 and 7. However, when the support members 12, 14, 16, 18 are splayed in the other direction, then the second, third and fourth support members 14, 16, 18 are moved to positions substantially 120° apart and the first support member 12 lies underneath the second support member 14, aligned therewith, as shown in FIG. 3. This is explained further below.

Referring now to FIGS. 4A to 4D, the first support member 12, which is the lowermost support member in the stack, has a circular spigot 26 formed on its uppermost side, which faces the other support members 14, 16, 18. A circular aperture 28 passes through the centre of the spigot 26 and through the planar surface of the support member and is axially aligned with the central axis 22. Where the circular aperture 28 passes through the underside of the support member 12, the periphery of the aperture is provided with a recess or counter-bore 30, as shown in FIG. 5.

An arcuate slot 32 is provided in the uppermost surface of the support member 12 and extends through an arc of substantially 90°. The arcuate slot 32 is concentric with the circular spigot 26 and circular aperture 28 about the axis 22. Circular recesses 34,36 are provided in the base of the slot at its respective ends. One end of the arcuate slot 32 is positioned substantially on a longitudinal axis 38 of the support member and the slot extends in an anti-clockwise direction away from the axis 38, as viewed.

The second support member, shown in FIG. 4B, has a circular aperture 40 therethrough, centred about the axis 22. The circular aperture 40 is sized to pass over the circular spigot 26 of the first support member 12, to allow the support members to pivot freely relative to one-another. A detent or cylindrical formation 42 is provided on the underside of the support member 14 and is disposed on a similar longitudinal axis 38 to that of the first member 12 and at the same radius from the axis 22 as the arcuate slot 32. The detent 42 is received in the slot 32, when the support member 14 is placed on the support member 12 and the support members are aligned one above the other. In this position the detent sits in the recess 34.

An arcuate slot 44 is provided in the uppermost surface of the support member 14 and extends through an arc of substantially 210°. The arcuate slot 32 is concentric with the circular aperture 40 about the axis 22 and extends through 90° in an anti-clockwise direction from the axis 38 and through 120° in a clockwise direction from the axis 38. A first circular recess 46 is provided in the base of the slot 44 in alignment with the axis 38 and second and third recesses 48,50 are provided in the base of the slot 44, at its ends.

The third support member, shown in FIG. 4C, is substantially identical to the second support member 14 and includes a detent 52, an arcuate slot 54, a first recess 56 in the base of the slot 54, second and third recesses 58, 60 and a circular aperture 62.

Referring particularly to FIG. 4D, the fourth and uppermost support member 18 has a detent 64 provided on its underside, which is arranged to slide in the arcuate slot 54 of the third support member. A hollow resilient spigot 66 extends downwardly from the underside of the support member, which is aligned with the axis 22. The spigot 66 is formed as a plurality of independent latching arms 68. The spigot is sized to pass through the circular aperture 28 at the centre of the spigot 26 of the first support member 12, by inward flexing of the latching arms 68. The latching arms 68 spring back and engage the recess 30 at the base of the aperture 28 when fully inserted, as best seen in FIG. 2.

A pair of formations 70, 72 are disposed on either side of the upward facing side of the fourth support member 18 for receiving the handle 20, which is pivotally mounted to the formations 70,72. Referring also to FIGS. 6A to 6C, the handle 20 is a substantially planar member having an aperture 74 at its upper end, the aperture 74 being large enough for an adult to grip the handle by placing two or more fingers through the aperture. A pair of resilient legs 76,78 extend from the lower end of the handle 20, which fit between the formations 70,72. Inwardly facing circular apertures 80,82 are provided in the formations 70,72, as shown in dotted outline in FIG. 6C, which receive respective cylindrical pivots 84,86 extending substantially outwardly from the resilient legs 76,78. As seen in FIG. 6B, the pivot 86 is provided with an angled end for facilitating insertion of the pivots 84,86 into the apertures 80,82. During assembly, the pivot 84 is inserted firstly into the aperture 80 and the second pivot 86 is then snap fitted into the aperture 82. An edge of the formation 72 is provided with an angled leading edge 90, which also facilitates insertion of the second pivot 86.

The inside edges of each formation 70,72 are also formed with V-shaped grooves 88 in a T-arrangement, as seen in FIG. 5. The outer edges of the resilient legs 76,78 are provided with corresponding V-shaped formations or detents 92,94 extending at 90° to one another. These detents 92,94 engage in their respective grooves 88 and lock the handle 20 in a position either lying flat on top of the upper support member 18, as shown in FIG. 6A, or in a position extending substantially perpendicularly away from the surface of the upper support member 18, as shown in FIG. 1. The handle 20 is securely locked in both positions, because in each position all four detents 92,94 are engaged in V-shaped slots. The resilience in the legs 76,78 allows rotation of the handle 20, with the legs flexing inwards to allow release of the detents 92,94.

When the vessel carrier 10 is assembled, the first support member 12 is arranged with the circular spigot 26 extending upwards. The second support member 14 is placed directly on top of the first support member 12 so that the detent 42 lies in the slot 32 and locates in the recess 34. The third second support member 16 is placed directly on top of the second support member 14 so that the detent 52 lies in the slot 44 and locates in the recess 46. The fourth support member 18 is then placed directly on top of the third support member 16, and the latching arms 68 of the resilient spigot 66 pushed into the aperture 28 of the circular spigot 28 until the latching arms 68 lock in the recess 30. A plug 96, shown in FIG. 5 is then inserted into the spigot 66 to hold the latching arms 68 in an engaged position. The handle 20 can then be attached to the formations 70,72 by insertion of the pivots 84,86, as described above.

The latching arms 68 hold the upper support member 18 to the lower support member 12, with the second and third support members 14,16 held between them. The second and third support members can rotate about the outside of the spigot 26 and the spigot 66 and upper support member rotate about the inside of the spigot 26. There is sufficient flexibility in the carrier 10 to allow the detents 42,52,64 to be deliberately moved out of their respective recesses, but sufficient rigidity to prevent accidental movement.

In use, the handle 20 can be rotated about the pivots 84,86 between a closed position, in which the handle lies flat against the upper support member 18, and an open or operative position, in which the handle extends perpendicularly away from the upper support member 18.

If the support members are rotated relative to one another in one direction, for example, if the lower support member 12 is held stationary and the second, third and fourth support members 14,16,18 are rotated in an anti-clockwise direction, then the detent 42 will slide in the arcuate slot 32 between the recess 34 and the recess 36, the detent 52 will slide in the arcuate slot between the recess 46 and the recess 50, and the detent 64 will slide in the arcuate slot between the recess 56 and the recess 60. When the detents 42,52,64 reach their respective recesses 36,50,60, the support members are held in a position lying substantially 90° apart, as shown in FIG. 1, allowing four vessels 98 to be carried. Rotation in the other direction allows the support members to be moved to a closed position.

If three vessels are to be carried, then the support members can be opened or splayed in the other direction. For example, the first and second support members 12,14 stay in a position lying directly on top of one-another, because the arcuate slot 32 does not extend beyond the axis 38, as shown in FIG. 4A. However the detent 52 slides in the slot 44 between the recess 46 and the recess 48 through an angle of 120° and the detent 64 slides in the slot 54 between the recess 56 and the recess 58 also through an angle of 120°. The drinking vessel carrier 10 is then arranged as shown in FIG. 3. The drinking vessel carrier 10 is closed by rotation of the support members 16, 18 in the other direction.

The drinking vessel carrier 10 is constructed from resilient plastics and is extremely tough and durable. The exposed flat surfaces of the support members can be printed with instructions for operation of the carrier 10 and also with advertising matter. The handle 20 locks securely into position relative to the support members, and the engagement of the detents 42,52,64 in the recesses in the slots 32,44,54 holds the support members in positions fixed relative to one another for storage and for use. This gives confidence in the carrier 10 when carrying drinks, for example, four pints of beer in beer glasses. The carrier is advantageous in that it has high rigidity, thus reducing the chance of spillages, and can be configured to carry two or four vessels, in the four vessel configuration, shown in FIGS. 1, 2 and 7, or three vessels in the three vessel configuration, shown in FIG. 3. The vessel carrier 10 closes to form a single substantially flat member, as shown in FIGS. 5 and 6A, which can easily be carried in a person's pocket.

The invention claimed is:

1. Drinking vessel carrier comprising a plurality of support members, each support member having a space therein for receiving a vessel to be supported, the support members being mounted in a stack about a pivotal axis and being adapted to be fanned out by rotation about the pivotal axis to different angular positions, wherein the support members are adapted to be retained in a first set of angular positions when rotated in one angular direction about the pivot and in a second set of angular positions when rotated in the other angular direction about the pivot; wherein co-operating formations are disposed on adjacent support members for retaining the support members in said first and second sets of angular positions; the co-operating formations retain the support members in a closed position in which the support members overlie one another; each co-operating formation includes a detent formed on one of said support members which slides within an arcuate slot formed in the adjacent support member.

2. A drinking vessel carrier as claimed in claim 1, wherein there are four support members mounted about the pivotal axis.

3. A drinking vessel carrier as claimed in claim 2, wherein the four support members are retained substantially 90 degrees apart when rotated in the first angular direction.

4. A drinking vessel carrier as claimed in claim 2, wherein three of the four support members are retained substantially 120 degrees apart when rotated in the other angular direction, the fourth support member under-lying one of the other support members.

5. A drinking vessel carrier as claimed in claim 1, wherein recesses are provided in the base of each arcuate slot corresponding to positions in which the adjacent support members are retained relative to one another.

6. A drinking vessel carrier as claimed in claim 1, wherein a handle is pivotally mounted to an uppermost support member about a pivotal axis and is movable between a closed position in which the handle lies flat against and is substantially parallel with the uppermost support member and an open position in which the handle extends substantially perpendicularly away from the uppermost support member.

7. A drinking vessel carrier as claimed in claim 6, wherein the handle includes a pair of resilient legs having spigots thereon for engagement with apertures provided in respective formations on a surface of the uppermost support member.

8. A drinking vessel carrier as claimed in claim 7, wherein detent means is provided on at least one of the resilient legs and locates in one of two recesses provided on the formations for locking the handle in the open and closed positions respectively.

9. A drinking vessel carrier as claimed in claim 1, wherein a resilient hollow spigot having catch means at a distil end thereof is provided on an outermost support member of the stack.

10. A drinking vessel carrier as claimed in claim 9, wherein a further hollow spigot is provided on the other outermost support member of the stack, the resilient hollow spigot being adapted to be received in the hollow spigot and the catch means to engage in a circumferential recess formed in the surface of the said other outermost support member.

11. A drinking vessel carrier as claimed in claim 10, wherein a plug is adapted to be inserted in the end of the resilient hollow spigot, thereby locking the catch means into engagement with the circumferential recess formed in the said other outermost support member.

12. A drinking vessel carrier as claimed in claim 11, wherein the outer surface of the hollow spigot provides a bearing surface for the or each other support member.

13. A drinking vessel carrier as claimed in claim 1, wherein the space for receiving a vessel to be supported is an aperture, an internal edge of which is formed with ridges for engagement with the vessel to be supported.

14. A drinking vessel carrier as claimed in claim 1, wherein the drinking vessel carrier is made from plastics.

* * * * *